US006039584A

United States Patent [19]

Ross

[11] Patent Number: 6,039,584

[45] Date of Patent: Mar. 21, 2000

[54] ELECTRICAL POWER DISTRIBUTION SYSTEM

[75] Inventor: Steven L. Ross, Pittsburgh, Pa.

[73] Assignee: Universal Electric Corporation, Bridgeville, Pa.

[21] Appl. No.: 09/188,612

[22] Filed: Nov. 9, 1998

[51] Int. Cl.[7] ..... H01R 25/14

[52] U.S. Cl. ..... 439/115; 439/857; 439/830

[58] Field of Search ..... 439/110, 113, 439/114, 115, 120, 830, 856, 857

[56] References Cited

U.S. PATENT DOCUMENTS

| | | | |
|---|---|---|---|
| 1,423,228 | 7/1922 | Leachman | 439/830 |
| 2,738,486 | 3/1956 | Wadsworth | 439/830 |
| 3,221,293 | 11/1965 | Regan | 439/830 |
| 3,489,981 | 1/1970 | Corl et al. . | |
| 3,503,032 | 3/1970 | Routh et al. . | |
| 3,588,413 | 6/1971 | Stanback | 439/830 |
| 3,801,951 | 4/1974 | Kemmerer et al. . | |
| 5,449,056 | 9/1995 | Ross . | |
| 5,503,259 | 4/1996 | Clopton et al. . | |
| 5,759,051 | 6/1998 | Cancellieri et al. . | |

FOREIGN PATENT DOCUMENTS

| | | | |
|---|---|---|---|
| 137038 | 8/1979 | Germany | 439/115 |

OTHER PUBLICATIONS

Ge Busway, 1997 Issue, p. 16–45.
Litelab Corp.

*Primary Examiner*—Gary F. Paumen
*Attorney, Agent, or Firm*—David W. Brownlee; Eckert Seamans Cherin & Mellott, LLC

[57] ABSTRACT

This invention is directed to an improved electrical power distribution system that provides continuous access for inserting take-off devices and also high current capacity. This invention provides enhanced electrical contact between the busbars and the stabs on take-off devices. This invention provides firm contact pressure and large contact surface area and allows a take-off device to be inserted at almost any point along the track. A unique retainer fits in a slot in the insulating support in the channel enclosure at each end of each busbar. The retainers are secured to the insulating support and thereby retain the busbar within the slot in the support.

24 Claims, 5 Drawing Sheets

ELECTRICAL POWER DISTRIBUTION SYSTEM

BACKGROUND OF THE INVENTION

1. Field of the Invention

This invention relates to an electrical distribution track in which multiple electrically-isolated, conductive busbars are housed in an elongated enclosure for feeding electricity to take-off devices that may be inserted into the track at any point along the length of the track to make electrical contact with the busbars.

2. Description of the Prior Art

It is common in factories, shops, offices and other buildings to provide overhead electrical power distribution tracks for providing a convenient source of electricity for lights, machines and other electrical devices in the buildings.

Electrical power distribution tracks are typically comprised of an elongated housing containing multiple electrically-isolated, conductive busbars. Track lighting and continuous plug-in busway are typical of this type of track system. Sections of the track can be joined together to form long runs for power distribution. Take-off devices are used to tap power from the track to the load apparatus. The load may be anything from a lamp to a three phase electrical machine. It is desirable to be able to insert take-off devices into or remove them from the track at any point along the track itself and make a secure electrical contact with the busbars.

It is also desirable that the electrical connection between take-off devices and the busbar not require bolts, crimps or other fastening hardware. A pressure connection is easily made or removed and is therefore the method of choice for most busbar to take-off device connections. However, as the ampere rating of the take-off device increases, it is necessary to increase both the contact area and pressure of the connection. Conventional systems are typically limited primarily in the contact area of the connection.

Some known busway systems use a rectangular shaped busbar with periodic sections where a take-off device may be inserted. The take-off devices have one or more stabs per busbar, each stab having at least two members that are spring loaded. When the device is inserted into the busway, these stabs press against the busbar to make the electrical connection. Take-off devices for these systems tend to be complex and expensive. These systems permit take-off devices to be installed only at predetermined locations.

It is also known to use distribution systems that include a formed busbar made of a spring-like material that exerts pressure on the stab of a take-off device when inserted. However, these systems are typically designed such that the contact surface area is a linear point contact along the width of the stab. Because of this, the contact surface is extremely small and can carry only limited current. Systems of this type are typically rated to a maximum of 60 amperes.

It is also known to use a "U" channel busbar in distribution systems, but such systems usually have limited current capacity. To increase the current capacity, copper must be added to the busbar profile, and that makes the profile more rigid and may no longer exert pressure on the contact. In addition, this U-shape does not readily conform to the shape of the stab. If the dimensional fit between the stab and the busbar is not precise, a point contact results as is described above.

None of these prior art systems are adaptable to provide both continuous access by take-off devices and high current capacity.

Typical busway sections are comprised of busbars and insulating support or supports which hold the busbars within an electrically conductive enclosure or housing. Sections can be as long as 20 feet. When the section is assembled, it is desirable that the busbars are fixed rigidly to the insulating support, and the insulating support is fixed rigidly to the enclosure. In many busway systems, the busbar slides into a slot in a continuous elongated insulating support.

There are several known techniques for retaining the busbar rigidly within its insulating support. These include a friction fit in which the busbar is pressed into its insulating support and is held in place by virtue of very tightly fitting components. This is a good method only when the busbar can be coextruded with a continuous insulator support. It is also useful when the busbar is supported at discrete locations by molded plastic components which snap around the busbar. This technique does not lend itself to systems where a continuous insulating support is desired and the busbars cannot be coextruded with the insulator. In a practical sense, only small rectangular profile busbars can be extruded.

Another technique is to fasten busbars to the insulating support by some fastening means such as a pin. Once the busbars have been positioned in the insulator, a hole is drilled through each busbar and the insulator, and then a pin is inserted which fixes the position of the busbars. While this method works, it is very labor intensive to manufacture.

At least one busway system is known in which the busbars are not fixed rigidly in place. The weakness in this approach is that the installer of such a system is responsible to position both the busbars within the insulator and the insulator within the enclosure. Positioning of these components is very important in maintaining safe separation between live electrical parts. A manufacturer cannot be assured that an installer will properly execute this procedure.

All prior art systems have significant drawbacks. The friction fit would not work in many systems because the busbar cannot be coextruded with the insulator in such systems. Fasteners work, but are very labor intensive. There is a need for a simple system to solve the problem.

SUMMARY OF THE INVENTION

The present invention solves the problems described above and satisfies the need for an improved power distribution track. This invention provides an improved electrical power distribution system that permits continuous access for inserting take-off devices and also has high current capacity. This invention provides enhanced electrical contact between the busbars and the stabs on take-off devices. It provides firm contact pressure and large contact surface area and allows a take-off device to be inserted at any point along the track.

This invention further provides a unique retainer that fits in a slot in the insulating support in the channel enclosure on at least one and preferably both ends of each busbar. The retainers are secured to the insulating support and thereby fix or retain the busbar in the slot in the support.

This invention includes an improved busbar having a generally U-shaped profile in cross-section with resilient substantially parallel re-entrant flanges.

DESCRIPTION OF THE PREFERRED EMBODIMENTS

Figure 1:
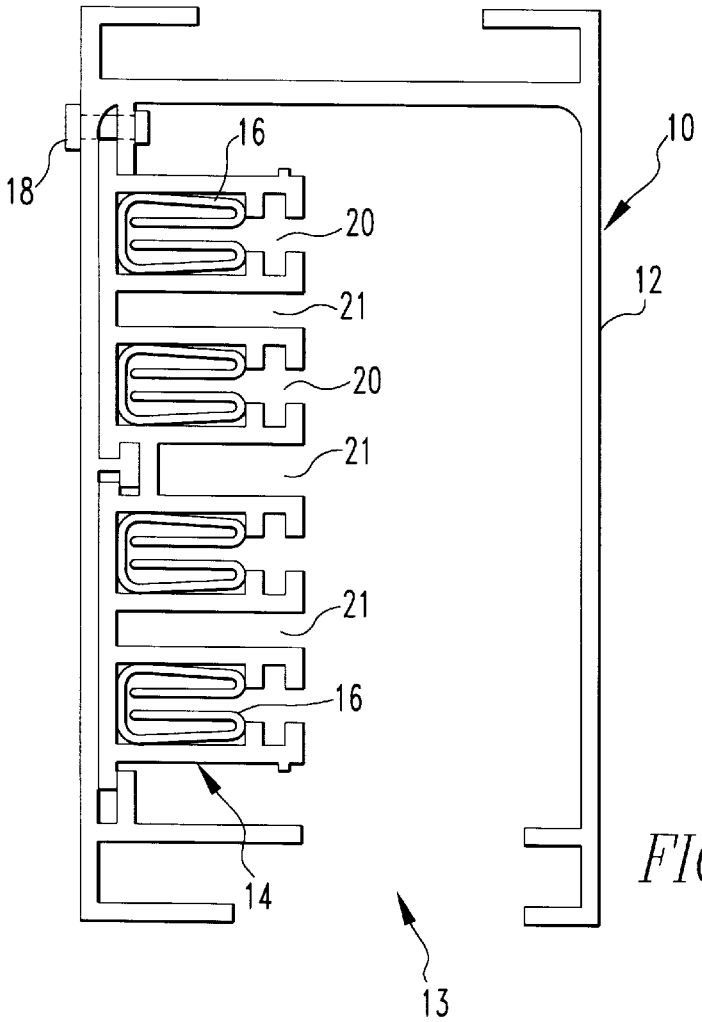
FIG. 1 is a cross-section through an electrical power distribution track of this invention.

FIG. 1 shows an electrical power distribution track 10 of this invention in cross-section. The busway run may include several track sections 10 which are joined end-to-end to make the distribution system. Each track section 10 may be up to 20 feet in length and any number of sections may be joined to form long runs of busways for power distribution. Power take-off devices (FIGS. 4 and 5) can be installed at any point along the busway except at the coupling between adjacent sections of the track.

Each section of the track 10 includes an enclosure 12 which is preferably a channel-shaped aluminum extrusion as is well known in the art. The enclosure 12 may be attached to a ceiling, wall or the like and is typically disposed with the mouth or access slot 13 to the channel, which is open downwardly as shown in FIG. 1.

Figure 2:
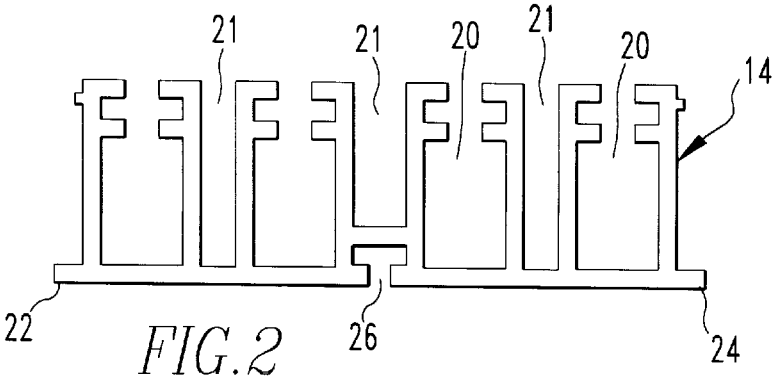
FIG. 2 is an end view of an insulating support from the track of FIG. 1.

The track 10 further includes an insulative support 14 secured in the enclosure 14 and a plurality (typically 3 or 4) of electrically conductive busbars 16 in the insulative support. The support 14 as best seen in FIG. 2 may have a plurality of longitudinal channels 20 in it for receiving and retaining the busbars 16 and secondary channels 21 for receiving flanges from a cover member as is described below. The support 14 preferably has flanges 22, 24 and a slot 26 for securing the support in the enclosure 12 which has flanges 28, 30 and rib 32 for engaging the flanges and slot in the support. A rivet 18 or other fastener may also be employed to further secure the support 14 in the enclosure 12 and prevent the support from sliding longitudinally along the enclosure. The support 14 is preferably made of electrically insulative and durable material such as pvc or other plastic material.

In accordance with this invention, the busbars 16 in track 10 have a unique configuration that provides firm contact pressure and a large contact surface area with stabs on take-off devices that can be inserted into the track 10 at almost any point along the length of the track. The busbar 16 is preferably made of copper strip material that may be tempered to be approximately half hard so as to be resilient or spring-like. The copper strip may be about 0.010 to 0.125 inch thick, and is more preferably about 0.030 to 0.050 inch thick. In one preferred embodiment the copper is about 0.040 inch thick. Aluminum strip may also be used in place of copper, but aluminum is not as conductive as copper and therefore not preferred.

Figure 3:
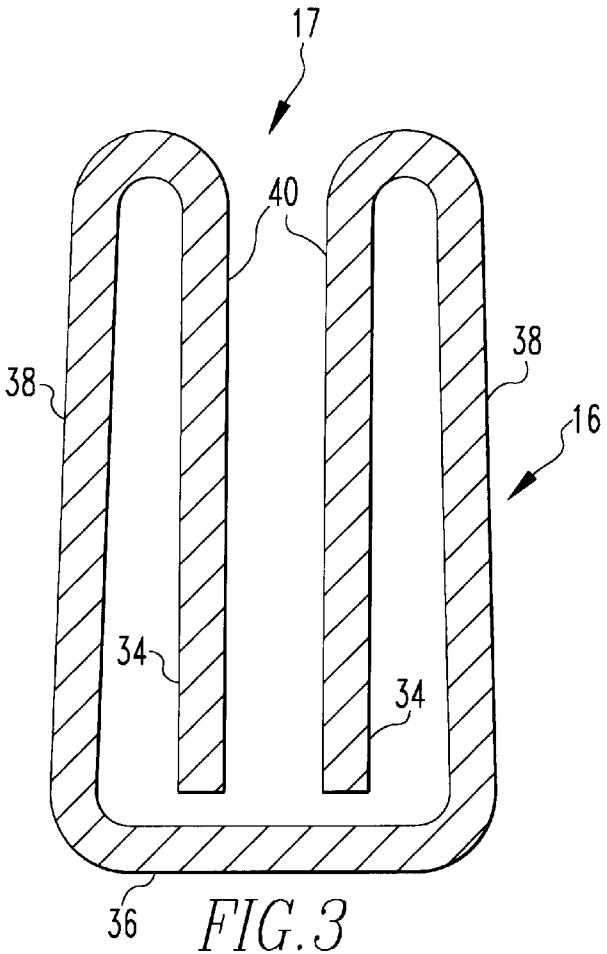
FIG. 3 is an enlarged cross-sectional view through a busbar from the track of FIG. 1.

Referring to FIG. 3, a busbar 16 of this invention has a generally U-shape with a slot opening 17 and a pair of substantially parallel, resilient (spring-like) interior flanges 34 for establishing pressure contact with a stab on a take-off device. The cross-section of the busbar 16 may include a base portion 36 with two legs 38 projecting from the base, and with the interior re-entrant flanges 34 extending rearward toward the base portion 36.

Figure 5:
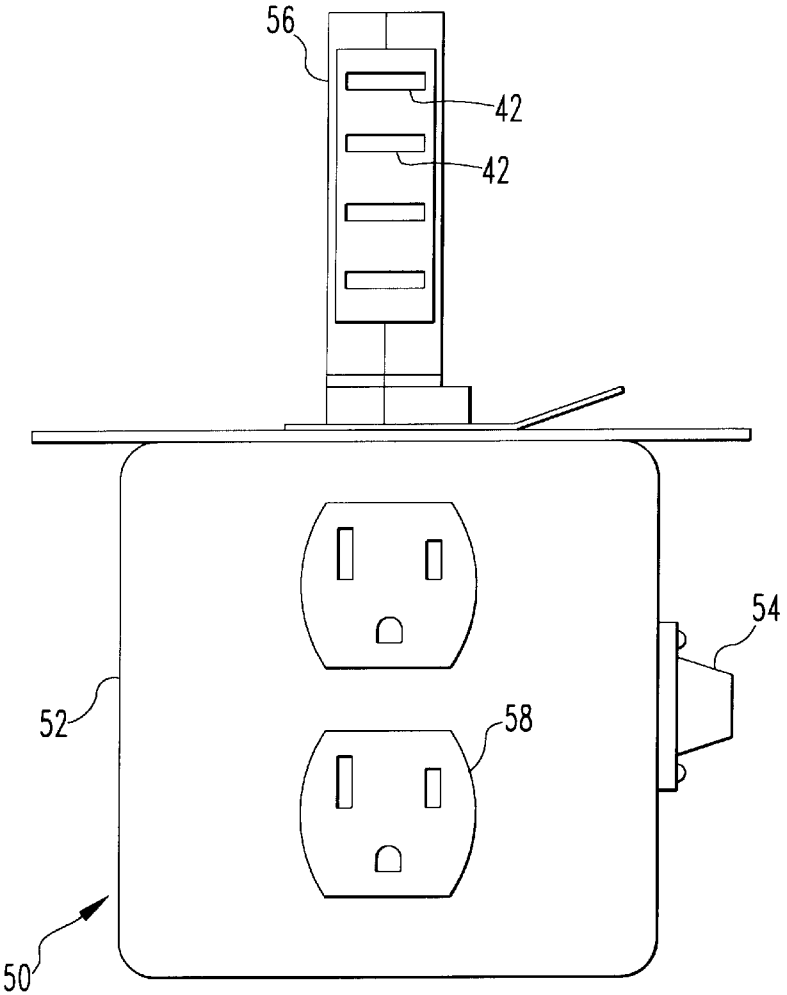
FIG. 5 is a vertical side elevation view of a take-off device for use with the track of FIG. 1.

The channels 20 in the support member 14 and the busbars 16 are dimensioned so the busbars will fit snugly in the channels; the slot opening 17 in the busbar 6 is sized to be smaller than the thickness of the stab on a take-off device to be inserted into the track. The interior end flanges 34 on the busbar 16, and particularly the interior contact surfaces 40 on the end flanges, are substantially parallel to each other and to the direction of a stab 42 as is seen in FIG. 5. The legs 38 of the busbar 16 preferably slightly converge toward one another from the base 36 of the busbar to the ends of the legs at the end flange connection. The busbar 16 may thus have a generally trapezoidal shape. The end flanges 34 are free to flex so as to allow the profile to conform to the stab 42 and maintain parallelism of the two contact surfaces 40 on the flanges 34 with contact surfaces 44 on the stab. This freedom of movement is permitted by the resiliency or spring-like nature of the metal of the busbar 16 and the profile of the busbar. The legs 38 can flex relative to the base 36 and the end flanges 34 can flex relative to the legs.

Figure 4:
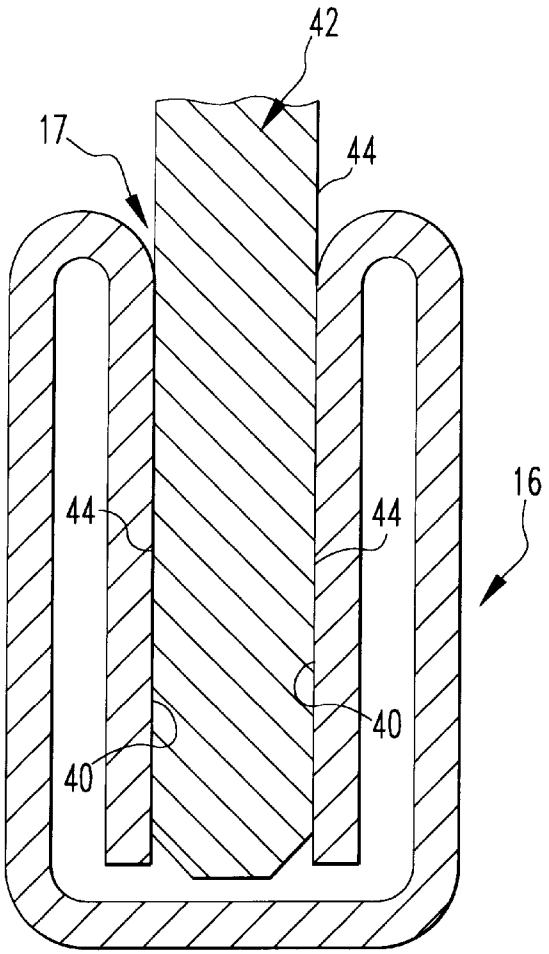
FIG. 4 is similar to FIG. 3 except additionally showing a stab from a take-off device inserted into the busbar.

FIG. 4 shows the busbar profile 16 after the stab 42 from a take-off device (FIGS. 5 and 6) has been inserted. The trapezoidal shape of the busbar 16 has now become more rectangular as the upper corners of the slot opening 17 have moved outward. The contact surfaces 40 on the busbar 16 remain parallel and pressed firmly against the stab 42 due to the flexible nature of the material and the fact that the natural slot opening 17 in the busbar is sized smaller than the stab thickness. This design accommodates some variation between the slot dimension and the stab thickness and still establish good surface contact. Total contact surface area between the stab 42 and the busbar 16 is twice the product of the height of the contact surface portion of the busbar and the width of the stab. In other words, both sides 44 of the stab 42 are in full contact with the parallel contact surfaces 40 of the busbar 16. Current flows from the busbar 16 to the take-off device through this surface area. When the take-off device is removed from the busway, the busbar 16 returns to its natural shape.

Figure 6:
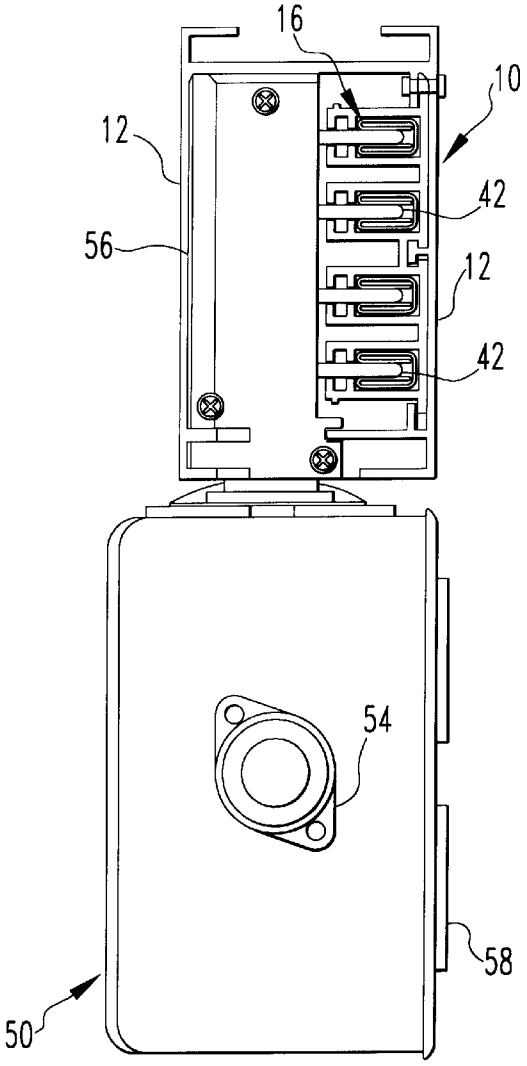
FIG. 6 is a vertical side elevation view of the take-off device of FIG. 5 rotated 90° and assembled with the track of FIG. 1.

FIGS. 5 and 6 show a typical plug-in take-off device 50 that can be used with an electrical power distribution track of this invention. A variety of take-off devices such as the device 50 are well known in the art. The device may include an enclosure 52, an overcurrent protection device 54, electrical outlets 58, a paddle 56 and multipole conductive stabs 42 on the paddle for making electrical contact with busbars 16 in a track 10. The take-off device 50 can be inserted in a track 10 of this invention at almost any point along its length by inserting paddle 56 into the open mouth of the enclosure 12 and rotating the device 90 degrees clockwise. Hanger bolts, not shown, may be used to secure the device 50 in the track 10.

Figure 7:
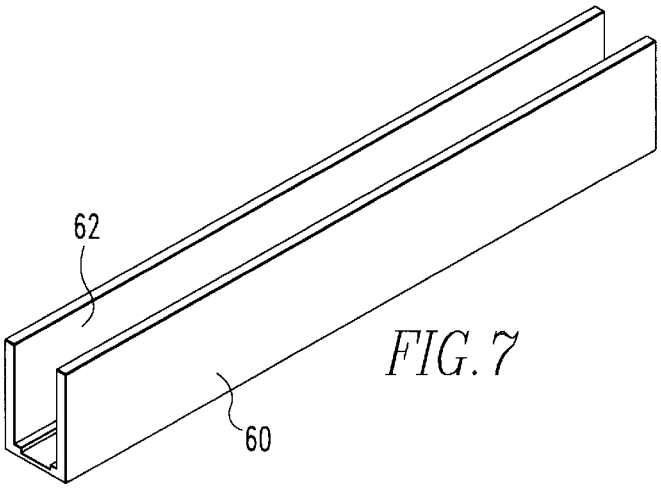
FIG. 7 is an enlarged perspective view of a busbar retainer.
Figure 8:
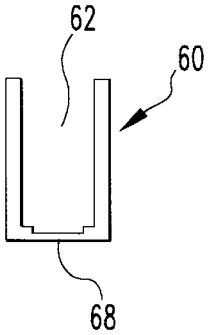
FIG. 8 is an end view of the retainer of FIG. 7.
Figure 9:
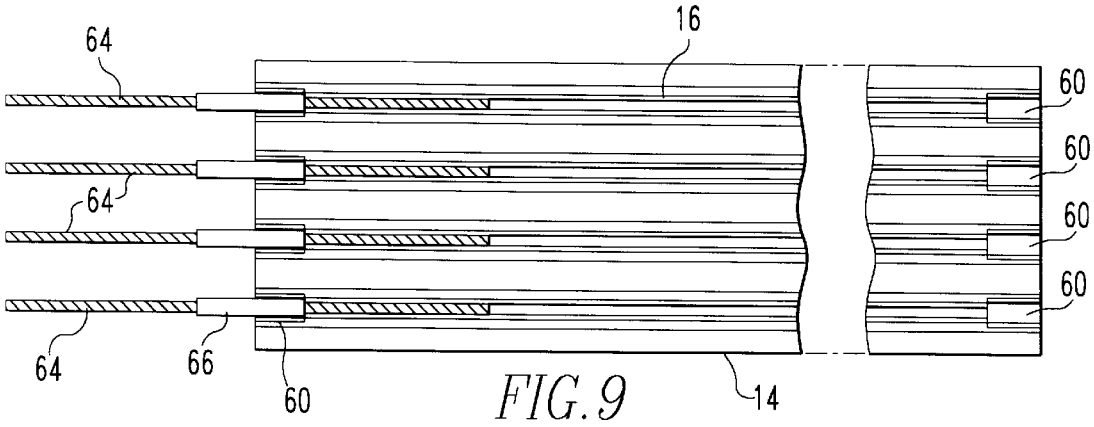
FIG. 9 is a vertical elevation view of the enclosure in the track such as the one shown in FIG. 1 as seen from the inside of the enclosure and showing an insulative support in the track and busbar retainers in the support.

FIGS. 7 and 8 show a busbar retainer 60 of this invention for retaining a busbar 16 in an insulative support 14 in a power distribution track 10. The retainer 60 is made of any suitable electrically insulating material such as pvc, which is preferably extruded to produce the elongated retainer. The retainer 60 has a generally U-shape, which is generally the same outline as the busbar 16 so as to fit in a slot 20 in the support 14 (see FIG. 9). The retainer 60 has an open slot 62 in its center which is designed to be large enough to accommodate the insulative portion of a connector bar 64 (FIG. 9). The retainer 60 has a thinner portion 68 at the bottom center of the slot 62 to avoid interference with the insulation 66 on the connector bar 64. The connector bars 64 are preferably copper bars having insulation 66 on them at a center portion of each bar that fits in the retainer 60.

In the assembly of a power distribution track 10 of this invention, the busbars 16 are inserted into a support 14. Adhesive is then applied on the outer surfaces of retainers 60 which are then inserted into each end of the slot 20 in the support 14 and pressed against the ends of the busbar. After the adhesive has cured, the retainers 60 prevent movement of the busbars 16 in the support 14. FIG. 9 shows an insulating support 14 with busbars 16, retainers 60 and connector bars 64 in the support. The support 14 can be positioned and secured in the enclosure 12 either before or after the busbars 16 and retainers 60 are secured in the support. The connector bars 64 are preferably positioned in the ends of the assembly after the support is secured in an enclosure 12.

Figure 10:
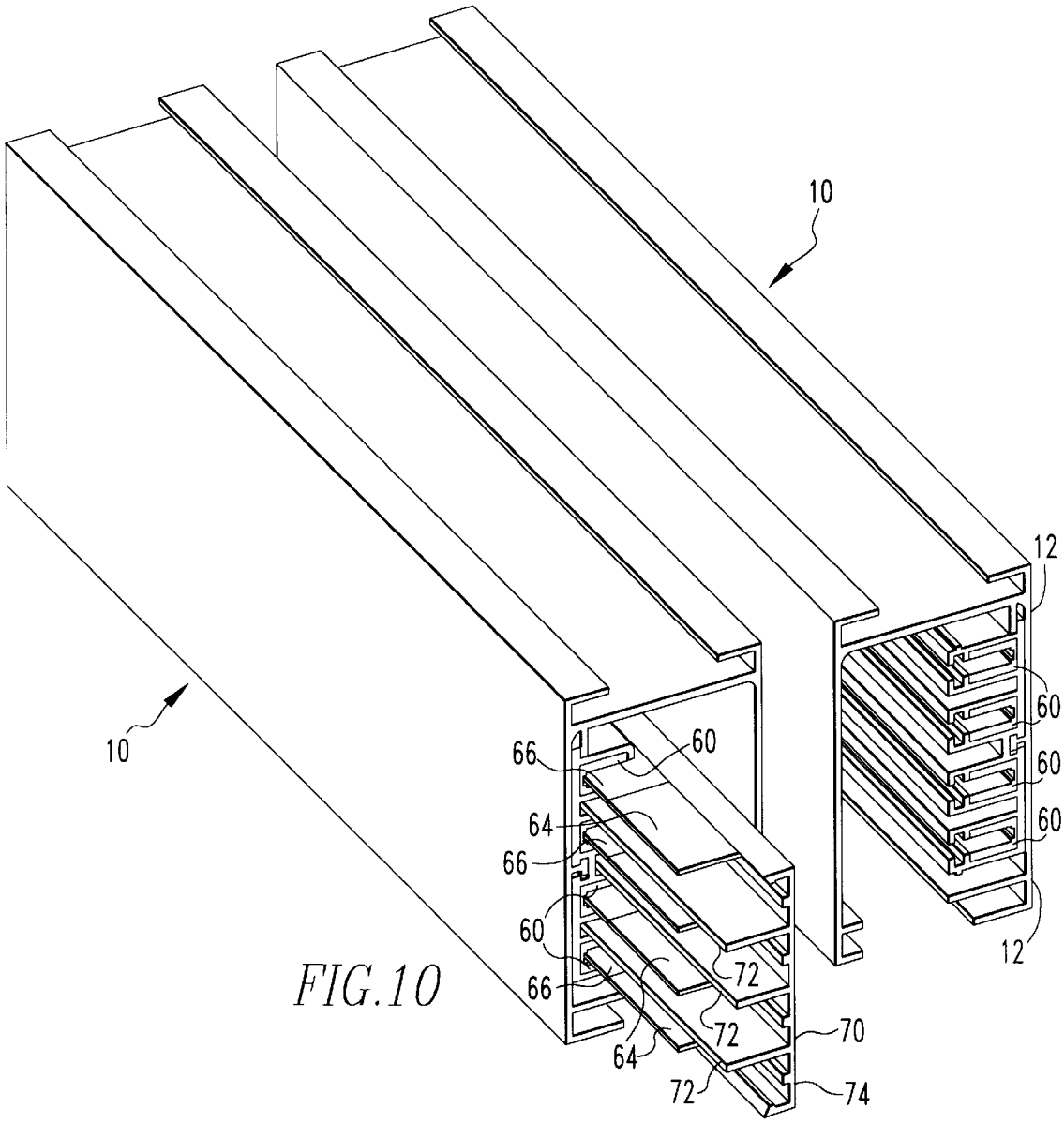
FIG. 10 is a perspective view of two side-by-side sections of an electrical power distribution track of this invention showing connector bars and a coupling cover in the end of one of the sections preparatory to connecting the two track sections.

FIG. 10 shows a male end and a female end of two sections of track 10 adapted to be connected to form a run of busway. The male end has connector bars 64 projecting from it and an insulative coupling cover 70 secured in the support 14 over the connector bars. The coupling cover 70 has three projecting flanges 72 that fit into slots 21 in the support 14 (see FIG. 2) and a cap portion 74 that covers the connector bars 64 at the ends of the track. The coupling cover 70 is preferably slightly longer than the connector bars 64, such as, for example, about one inch longer on each end.

The coupling cover 70 acts to eliminate an air spacing between live electrical parts, i.e., the connector bars 64, in power distribution track 10. The connector bars 64 are preferably about the same height as the depth of the slot 20 in the support 14, so the tops of the bars 64 are disposed at approximately the top of the slots. Depending on the size of the track 10, the spacing between the bars may be less than one inch, which Underwriters Laboratories requires for air spacings between live parts. The flanges 72 on the coupling cover are disposed between the connector bars 64 and eliminate the air space between the tops of the adjacent bars.

It is therefore seen that this invention provides an improved electrical power distribution system which enables insertion of take-off devices at any point along the length of the track and which provides firm contact pressure surface are and large contact between the busbars in the track and the stabs on the take-off device. This invention also provides retainers for securing busbars in the insulative support in a busway track and provides an enhanced system for interconnecting sections of a distribution track.

The embodiments disclosed herein are illustrative. It is understood that various changes can be made to the preferred embodiments without departing from the invention or the scope of the claims appended hereto.

What is claimed is:

1. An electrical power distribution system comprising:

at least two track sections connected end-to-end, each said track section including an elongated metal enclosure, an elongated insulating support member secured in said enclosure and at least one electrically conducting busbar in said support member for providing electricity to a take-off device installed at any point along the length of said track;

said at least one electrically conducting busbar made of copper strip material about 0.010 to 0.125 inch thick having a generally U-shaped cross section including a base portion between a pair of spaced apart legs and an integral interior re-entrant flange on the end of each leg opposite said base, said re-entrant flanges being substantially parallel and cooperating to define a slot therebetween for receiving an electrically conductive stab on a take-off device installed in said track and provide interfacial pressure contact against said stab; and an electrically conductive connector bar in each said busbar interconnecting it with a busbar in the adjacent track section.

2. An electrical power distribution track as set forth in claim 1 in which said re-entrant flanges and said legs are of approximately equal length.

3. An electrical power distribution track as set forth in claim 2 in which said legs converge slightly toward one another from said base toward the ends of each leg opposite said base.

4. An electrical power distribution track as set forth in claim 3 in which said re-entrant flanges are substantially planar.

5. An electrical power distribution track as set forth in claim 4 in which said copper strip material is of approximately half-hard temper.

6. An electrical power distribution track as set forth in claim 1 in which said track includes at least two of said busbars in said insulating support.

7. An electrical power distribution track as set forth in claim 1 in which said enclosure comprises an extruded aluminum channel member and said insulating support is secured in said channel against one side face of the channel.

8. An electrical power distribution track as set forth in claim 7 in which said insulating support has a plurality of grooves in it, which are open toward the center of said channel and each channel has a busbar in it.

9. An electrically conducting busbar for an electrical power distribution track, said busbar being made of copper strip material about 0.030 to 0.050 inch thick in approximately half-hard temper and having a generally U-shaped cross-section including a base portion between a pair of spaced apart legs projecting from said base and an integral interior re-entrant flange on the end of each leg opposite said base, said legs converge slightly toward one another from said base to the end of said legs at said re-entrant flanges, said re-entrant flanges each being substantially planar and parallel to one another and cooperating to define a slot therebetween for receiving an electrically conductive stab on a take-off device installed in said track and provide interfacial pressure against said stab.

10. A busbar as set forth in claim 9 in which said legs and said re-entrant flanges are of approximately equal length.

11. A busbar as set forth in claim 9 in which said base is substantially planar and each of said legs forms an included angle of less than about 90° with said base.

12. A busbar as set forth in claim 11 in which said included angle is about 85°.

13. In an electrical power distribution track including an elongated metal enclosure, an elongated insulating support member secured in said enclosure having at least one longitudinal groove in said support and an electrically conducting U-shaped busbar in said at least one groove, said busbar having a slot in it for receiving a stab from a take-off device, the improvement comprising an electrically insulating busbar retainer secured in said groove on both ends of said track and said retainer has a generally U-shaped cross-sectional profile defining a slot for receiving an electrically conducting connector bar for electrically joining said track to another electrical power distribution track of like construction.

14. An electrical power distribution track as set forth in claim 13 in which said retainer is adhesively bonded in said groove.

15. An electrical power distribution track as set forth in claim 13 in which said support member has at least said two grooves and a busbar with said two retainers in each said groove.

16. An electrical power distribution track as set forth in claim 15 which includes a plurality of said enclosures with support members, busbars and retainers in them and said enclosures are electrically and mechanically connected end-to-end and with electrically conductive connector bars disposed in said retainers and the ends of said busbars.

17. An electrical power distribution track as set forth in claim 16 which includes an electrically insulating coupling cover in said track at each end-to-end connection between said enclosures to eliminate air spacing between said connector bars.

18. An electrical power distribution system comprising a plurality of elongated, channel-shaped enclosures butted end-to-end, an elongated insulating support member secured in each said enclosure, each said support member having at least two slots in it open inwardly into said enclosure, U-shaped electrically conducting busbars in said slots, electrically conductive connector bars in the abutting ends of busbars in the adjacent enclosures, and an electrically insulating coupling cover at each interconnection between enclosures and disposed inside said enclosures with portions of said coupling cover disposed between adjacent connector bars to provide electrical separation between them.

19. An electrical power distribution system as set forth in claim 18, which includes electrically insulative retainer members secured in said slots in said support member on both ends of said busbar in the slot.

20. An electrical power distribution system having at least two track sections connected end-to-end, each said track section including an elongated metal enclosure, an elongated insulating support member secured in said enclosure and having at least one longitudinal groove in said support member and an electrically conducting busbar in said groove for providing electricity to a take-off device installed in said track;

said at least one electrically conducting busbar having a generally U-shaped cross-section including a base portion between a pair of spaced apart legs that converge slightly toward one another proceeding from said base portion and an integral interior re-entrant flange on the end of each leg opposite said base, said re-entrant flanges being substantially parallel and cooperating to define a slot therebetween for receiving an electrically conductive stab on a take-off device installed in said track and provide interfacial pressure contact against said stab; and an electrically conducting connector bar in and interconnecting said busbars in the adjacent ends of said two track sections.

21. An electrical power distribution system as set forth in claim 20 in which each said enclosure has at three grooves in it and one of said busbars in each said groove and further having one of said connector bars in each of said busbars in the adjacent ends of said two track sections.

22. An electrical power distribution system as set forth in claim 21 in which each of said busbars is made of copper strip material about 0.030 to 0.050 inch thick and the copper is approximately half-hard temper.

23. An electrical power distribution system as set forth in claim 21 which further includes an insulating busbar retainer secured in said groove on both ends of said track.

24. An electrical power distribution system having at least two track sections connected end-to-end, each said track section including an elongated metal enclosure, an elongated insulating support member secured in said enclosure and having at least one longitudinal groove in said support member and an electrically conducting busbar in said groove for providing electricity to a take-off device installed at any point along the length of said track;

said at least one electrically conducting busbar having a generally U-shaped cross section including a base portion between a pair of spaced apart legs and an integral interior re-entrant flange on the end of each leg opposite said base, said re-entrant flanges being substantially parallel and cooperating to define a slot therebetween for receiving an electrically conductive stab on a take-off device installed in said track and provide interfacial pressure contact against said stab; and a U-shaped insulating busbar retainer in said groove in said support member in each track section at the end thereof connected to another said track section and an electrically conducting connector bar in said retainers interconnecting the adjacent track sections.

* * * * *

UNITED STATES PATENT AND TRADEMARK OFFICE

CERTIFICATE OF CORRECTION

PATENT NO. : 6,039,584
DATED : March 21, 2000
INVENTOR(S) : Steven L. Ross

It is certified that error appears in the above-identified patent and that said Letters Patent is hereby corrected as shown below:

Column 8,
Line 23, "claim 21" should read -- claim 20 --.

Signed and Sealed this

Sixth Day of August, 2002

*Attest:*

*Attesting Officer*

JAMES E. ROGAN
*Director of the United States Patent and Trademark Office*